US009589410B2

(12) United States Patent
Nishino et al.

(10) Patent No.: US 9,589,410 B2
(45) Date of Patent: Mar. 7, 2017

(54) PAPER MONEY HANDLING APPARATUS

(71) Applicant: Hitachi-Omron Terminal Solutions, Corp., Shinagawa-ku, Tokyo (JP)

(72) Inventors: Akira Nishino, Tokyo (JP); Masayasu Ueno, Tokyo (JP); Takeshi Kanagawa, Tokyo (JP); Yukihiro Mabuchi, Tokyo (JP)

(73) Assignee: Hitachi-Omron Terminal Solutions, Corp., Tokyo (JP)

( * ) Notice: Subject to any disclaimer, the term of this patent is extended or adjusted under 35 U.S.C. 154(b) by 0 days.

(21) Appl. No.: 14/888,292

(22) PCT Filed: Jun. 3, 2013

(86) PCT No.: PCT/JP2013/003490
§ 371 (c)(1),
(2) Date: Oct. 30, 2015

(87) PCT Pub. No.: WO2014/195989
PCT Pub. Date: Dec. 11, 2014

(65) Prior Publication Data

US 2016/0063793 A1 Mar. 3, 2016

(51) Int. Cl.

| | |
|---|---|
| ***G07F 7/04*** | (2006.01) |
| ***G07D 11/00*** | (2006.01) |
| ***G07D 7/00*** | (2016.01) |

(52) U.S. Cl.
CPC ..... *G07D 11/0084* (2013.01); *G07D 7/00* (2013.01); *G07D 11/0081* (2013.01)

(58) Field of Classification Search
CPC ..... G07D 11/0003; G07D 11/0006; G07D 11/0009; G07D 11/0018; G07D 11/0081;
(Continued)

(56) References Cited

U.S. PATENT DOCUMENTS 4,510,380 A 4/1985 Uchida et al.
8,701,858 B2 * 4/2014 Iwamura ..... G07D 11/0066 194/206

(Continued)

FOREIGN PATENT DOCUMENTS

JP 57-209591 12/1982
JP 2004-110289 A 4/2004

(Continued)

OTHER PUBLICATIONS

PCT International Search Report on application PCT/JP2013/003490 mailed Jul. 2, 2013; 5 pages.

*Primary Examiner* — Mark Beauchaine
(74) *Attorney, Agent, or Firm* — Foley & Lardner LLP

(57) ABSTRACT

Provided is a paper money handling apparatus of which the security of a paper money process unit is improved, the jam is easily removed, and the layout is easily changed while the operability thereof is ensured. The paper money handling apparatus includes a repository, a temporary storage container, and a money deposit/withdrawal slot. The repository is provided inside a safe so as to store paper money therein. The temporary storage container is provided inside the safe so as to temporarily store deposited paper money therein during a transaction. The money deposit/withdrawal slot serves as an entry/exit opening of a paper money passageway provided at the upper part of the safe so as to communicate with the repository and the temporary storage container.

8 Claims, 19 Drawing Sheets

(58) Field of Classification Search
CPC ..... G07D 11/0021; G07D 11/0033; G07D 11/0084; G07D 11/009; G07D 11/0096; G07D 2211/00; G07D 7/00; G07D 13/00
See application file for complete search history.

(56) References Cited

U.S. PATENT DOCUMENTS

| | | | | |
|---|---|---|---|---|
| 2004/0007624 | A1* | 1/2004 | Ogawa ..... | B65H 1/00 235/475 |
| 2004/0134839 | A1 | 7/2004 | Kobayashi et al. | |
| 2004/0182677 | A1* | 9/2004 | Katou ..... | B65H 1/025 194/206 |

FOREIGN PATENT DOCUMENTS

| | | | |
|---|---|---|---|
| JP | 2004-145600 | A | 5/2004 |
| JP | 2005-085134 | A | 3/2005 |
| JP | 2006-209580 | A | 8/2006 |

* cited by examiner

PAPER MONEY HANDLING APPARATUS

TECHNICAL FIELD

The present invention relates to a paper money handling apparatus.

BACKGROUND ART

In many cases, a paper money handling apparatus is mounted on an ATM (Automatic Teller Machine). The ATM is a machine that automatically carries out the deposit and withdrawal of money by a user's operation. In general, the paper money handling apparatus is provided so that a part or the entirety thereof is disposed inside a safe in order to improve the security. In order to improve the security, a method of thickening the wall of the safe is known. However, when the wall of the safe is thickened in a state where the paper money handling apparatus is entirely provided inside the safe, the operability for the deposit and withdrawal becomes poor.

Patent Document 1 discloses a paper money handling apparatus in which a money deposit/withdrawal slot is provided outside a safe and the other units are stored inside the safe. In the paper money handling apparatus, the money deposit/withdrawal slot is provided in a front surface of the safe in order to improve the operability and the security and to easily remove a paper money jam (corresponding to the clogging of paper money) during a system failure.

CITATION LIST

Patent Document

Patent Document 1: JP 2006-209580 A

SUMMARY OF THE INVENTION

Problems to be Solved by the Invention

The paper money handling apparatus of the related art has at last one of the following problems (A), (B), and (C). (A) Since the paper money input direction is horizontal, the paper money may be drooped due to the own weight when a large amount of the paper money is deposited, and hence the operability is not good. (B) Since the paper money input direction is horizontal, foreign matter such as coin nipped in the paper money easily enters the apparatus. (C) When the front-face apparatus (having a configuration in which the money deposit/withdrawal slot is provided near the door of the safe) is changed as the rear-face apparatus (having a configuration in which the money deposit/withdrawal slot is provided at the opposite side to the door of the safe) or the rear-face apparatus is changed as the front-face apparatus, the layout of the components disposed inside the safe needs to be changed.

Therefore, an object of the invention is to provide a paper money handling apparatus of which the security of a paper money process unit is improved, the jam is easily removed, and the layout is easily changed while the operability thereof is ensured.

Solutions to Problems

In order to solve the above-described problems, according to the invention, provided is a paper money handling apparatus including: a repository which is provided inside a safe so as to store paper money therein; a temporary storage container which is provided inside the safe so as to temporarily store deposited paper money therein during a transaction; a money deposit/withdrawal slot which is provided outside the safe and is provided with a pocket inclined with respect to a horizontal plane so that a user extracts paper money placed thereon; and a conveyance unit which penetrates a top surface of the safe so as to convey paper money among the repository, the temporary storage container, and the money deposit/withdrawal slot.

Effect of the Invention

According to the invention, at least one of the following effects can be obtained. (a) Since the paper money is input while being inclined with respect to the horizontal plane when a large amount of the paper money is deposited, the paper money is not easily drooped due to the own weight, and hence the operability is good. (b) Since the paper money is input while being inclined with respect to the horizontal plane, foreign matter such as coin nipped in the paper money easily falls, and hence the possibility that foreign matter enters the apparatus decreases. (c) Since the conveyance unit penetrates the top surface of the safe, the arrangement of the money deposit/withdrawal slot can be easily changed. (d) Since the money deposit/withdrawal slot is disposed outside the safe, the possibility of performing the recovery operation without opening the safe increases even when foreign matter enters the apparatus. (e) Since the storage container and the temporary storage container are disposed inside the safe, the security can be improved.

MODE FOR CARRYING OUT THE INVENTION

Hereinafter, embodiments will be described with reference to the drawings.

First Embodiment

Figure 1:
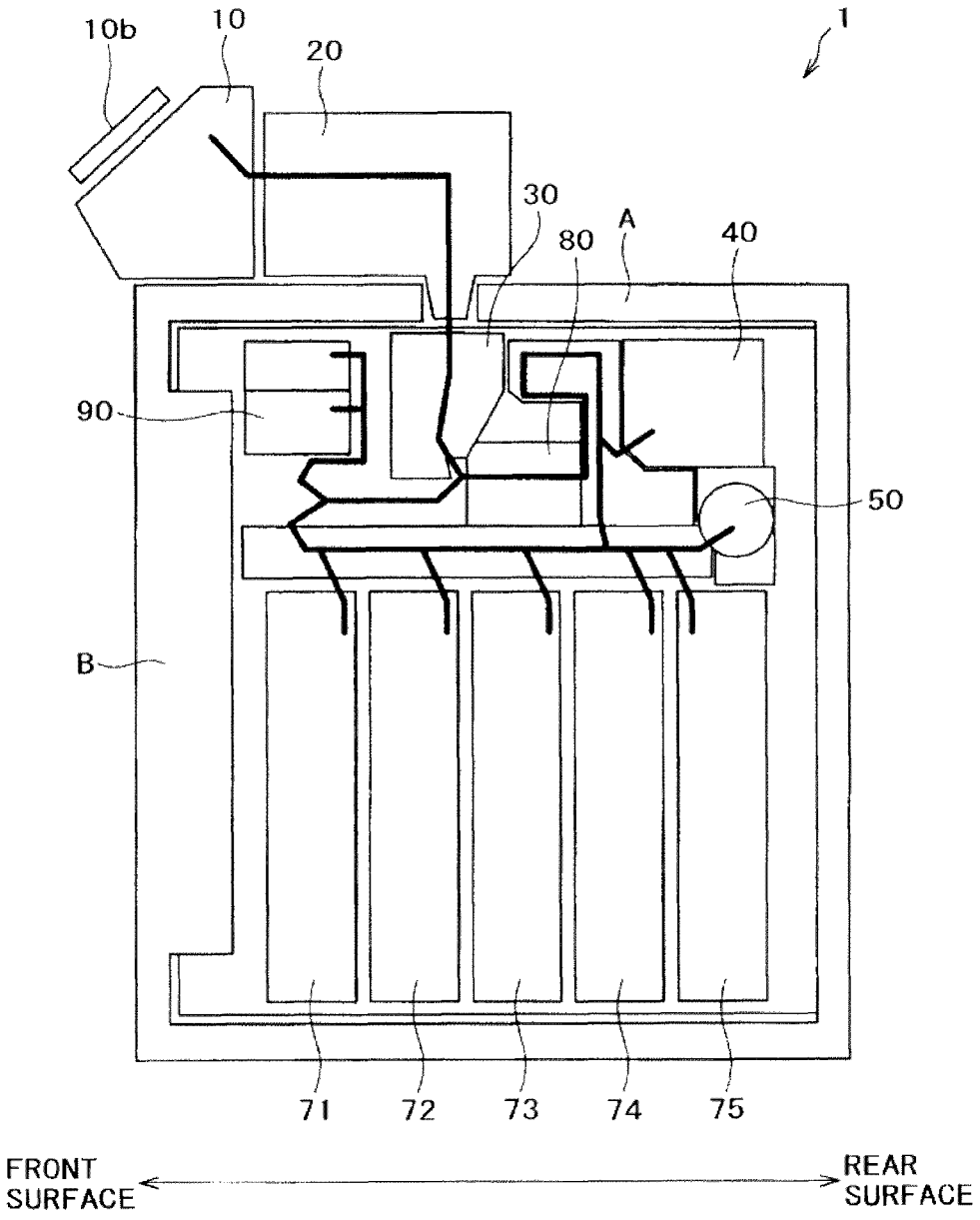
FIG. 1 is a diagram illustrating a configuration of a front-face apparatus.

FIG. 1 is a cross-sectional view of a paper money handling apparatus 1 mounted on a safe A.

An example illustrated in FIG. 1 indicates the paper money handling apparatus 1 as a front-face apparatus. The paper money handling apparatus 1 includes a money deposit/withdrawal slot 10, a conveyance path 20, a conveyance path 30, a determination unit 80, a temporary storage container 40, a returning temporary storage container 50, storage containers 71 to 75, and a withdrawal storage container 90. The money deposit/withdrawal slot 10 and the conveyance path 20 are provided on the top surface of the safe A. The money deposit/withdrawal slot 10 is disposed in the vicinity of the front surface. The front surface indicates a surface provided with a door B of the safe A. The other components are disposed inside the safe A. The withdrawal storage container 90 is disposed in the vicinity of the door B of the safe A. The storage containers 71 to 75 are disposed at the lower part of the paper money handling apparatus 1 in a direction from the front side (the front-face side) toward the rear side (the rear-face side).

The money deposit/withdrawal slot 10 is used for a user to input or extract paper money. The money deposit/withdrawal slot 10 includes a pocket 10*a* and a shutter 10*b*. The pocket 10*a* forms a space in which paper money is obliquely placed. The oblique state indicates a state where the paper money is inclined with respect to a horizontal plane.

The conveyance path 20 and the conveyance path 30 are used to convey the paper money. The conveyance of the paper money is performed by a known roller (not illustrated) or the like. The determination unit 80 is used to determine the kind and the authenticity of the paper money. The determination unit 80 can determine any one of the paper money conveyed from the front side toward the rear side and the paper money conveyed from the rear side toward the front side. Based on the authenticity determination result, the determination unit 80 determines whether to return or receive the deposited paper money. The temporary storage container 40 is used to temporarily store the paper money until the transaction of the paper money deposited by the user is admitted. The returning temporary storage container 50 is used to temporarily store the paper money which is determined not to be received in the deposited paper money. The returning temporary storage container 50 corresponds to the "second temporary storage container" of claims.

The storage containers 71 to 75 are used to store the paper money in accordance with the type of the paper money. A storage container 74 or a storage container 75 may be used as a storage container for storing the paper money not to be deposited or withdrawn. In the first embodiment, the storage container 75 is used as a storage container. The withdrawal storage container 90 is used to collect the counterfeit paper money or to store the paper money which is not extracted forgetfully by the user. The withdrawal storage container 90 is provided near the door of the safe.

Figure 2:
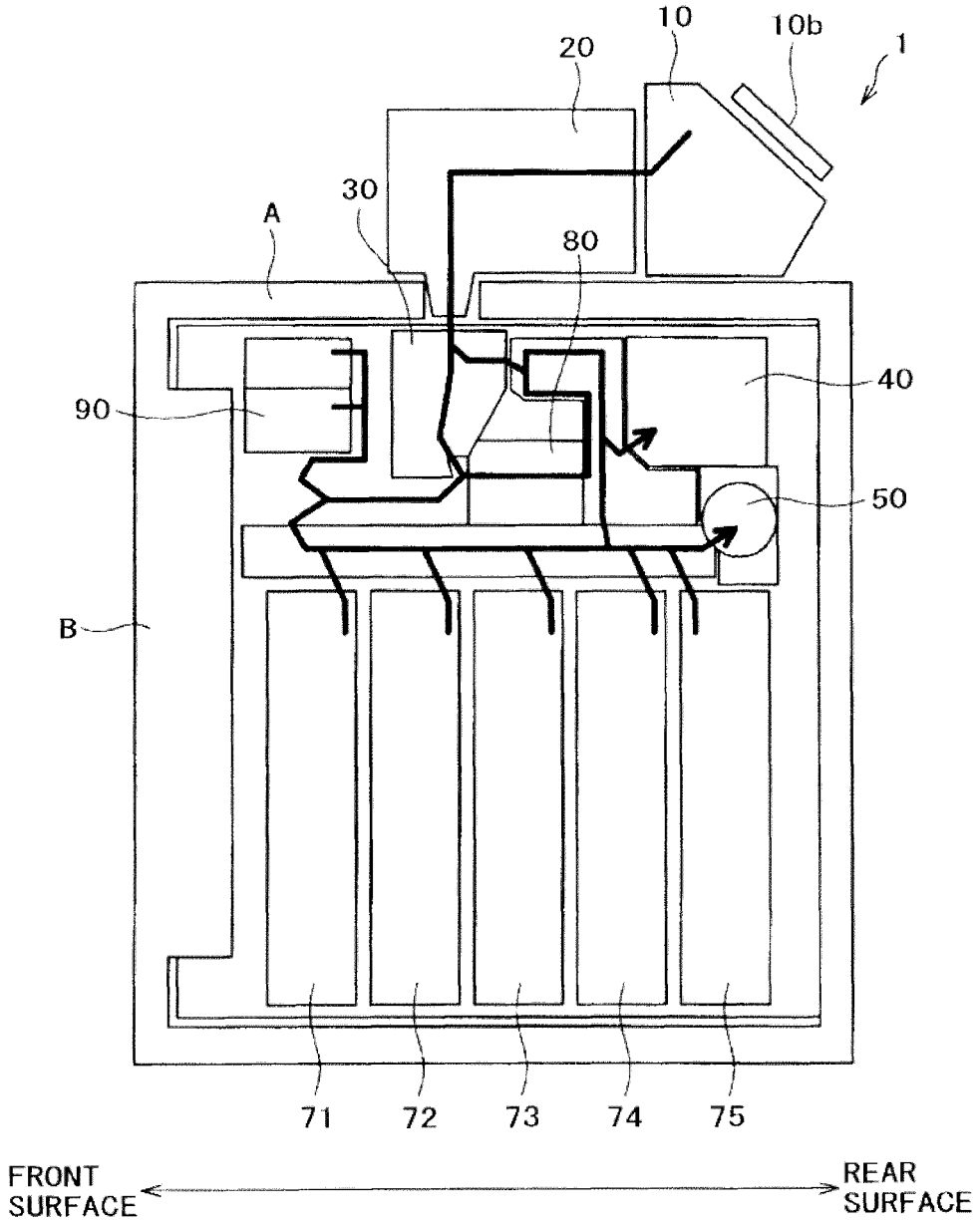
FIG. 2 is a diagram illustrating a configuration of a rear-face apparatus.

FIG. 2 illustrates the paper money handling apparatus 1 provided as a rear-face apparatus.

Figure 3:
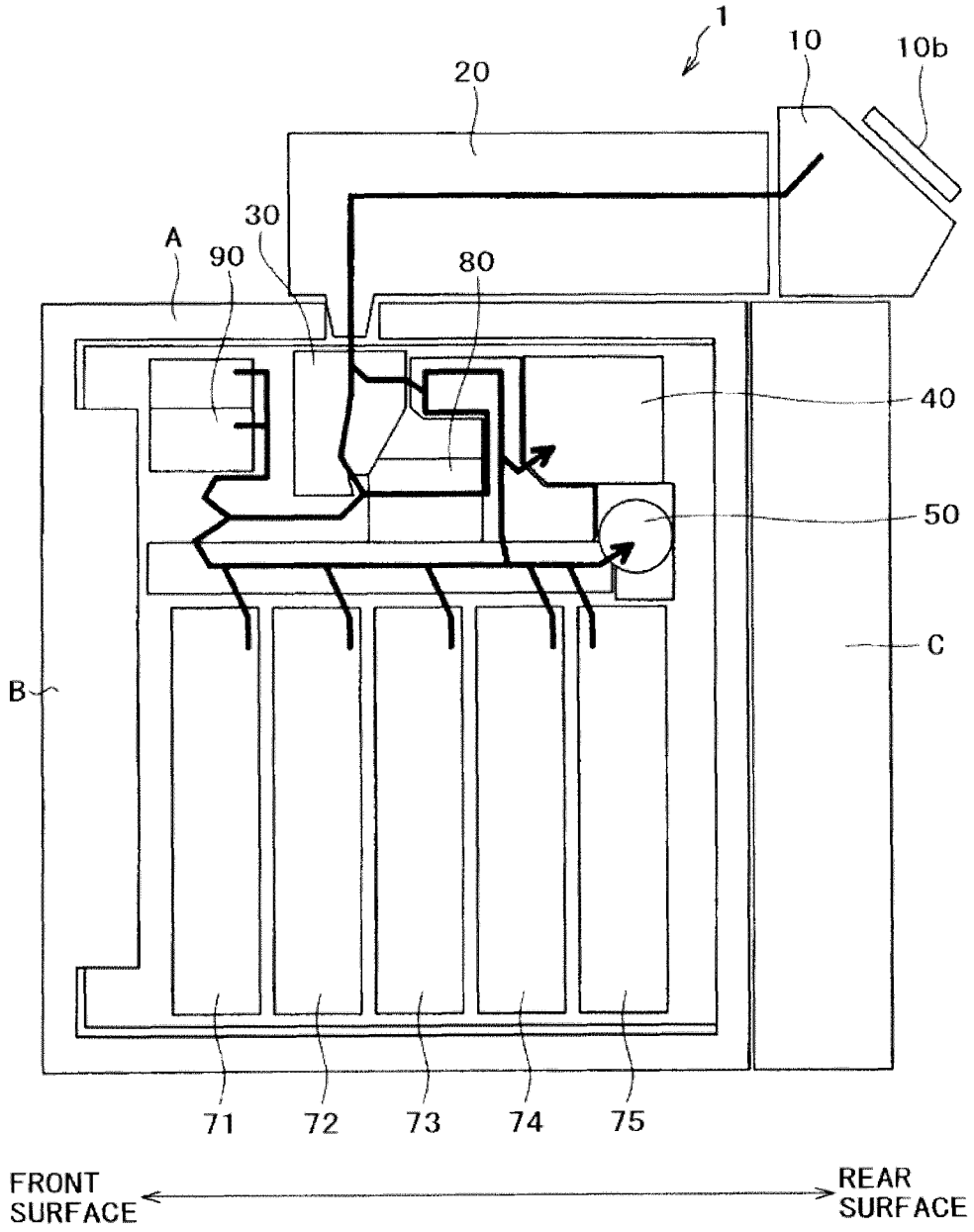
FIG. 3 is a diagram illustrating a configuration of a wall-face apparatus.

FIG. 3 illustrates the paper money handling apparatus 1 of a wall face type provided by the use of a wall C.

In the front-face apparatus (FIG. 1), the rear-face apparatus, and the wall-face apparatus, the money deposit/withdrawal slot 10 and the conveyance path 20 are arranged in a different way, but the configuration inside the safe A is the same. That is, the front-race apparatus, the rear-face apparatus, or the wall-face apparatus can be realized in accordance with a change in the mounting direction of the money deposit/withdrawal slot 10 and the conveyance path 20. With this configuration, the main units or components inside the sale can be commonly used.

Figure 4:
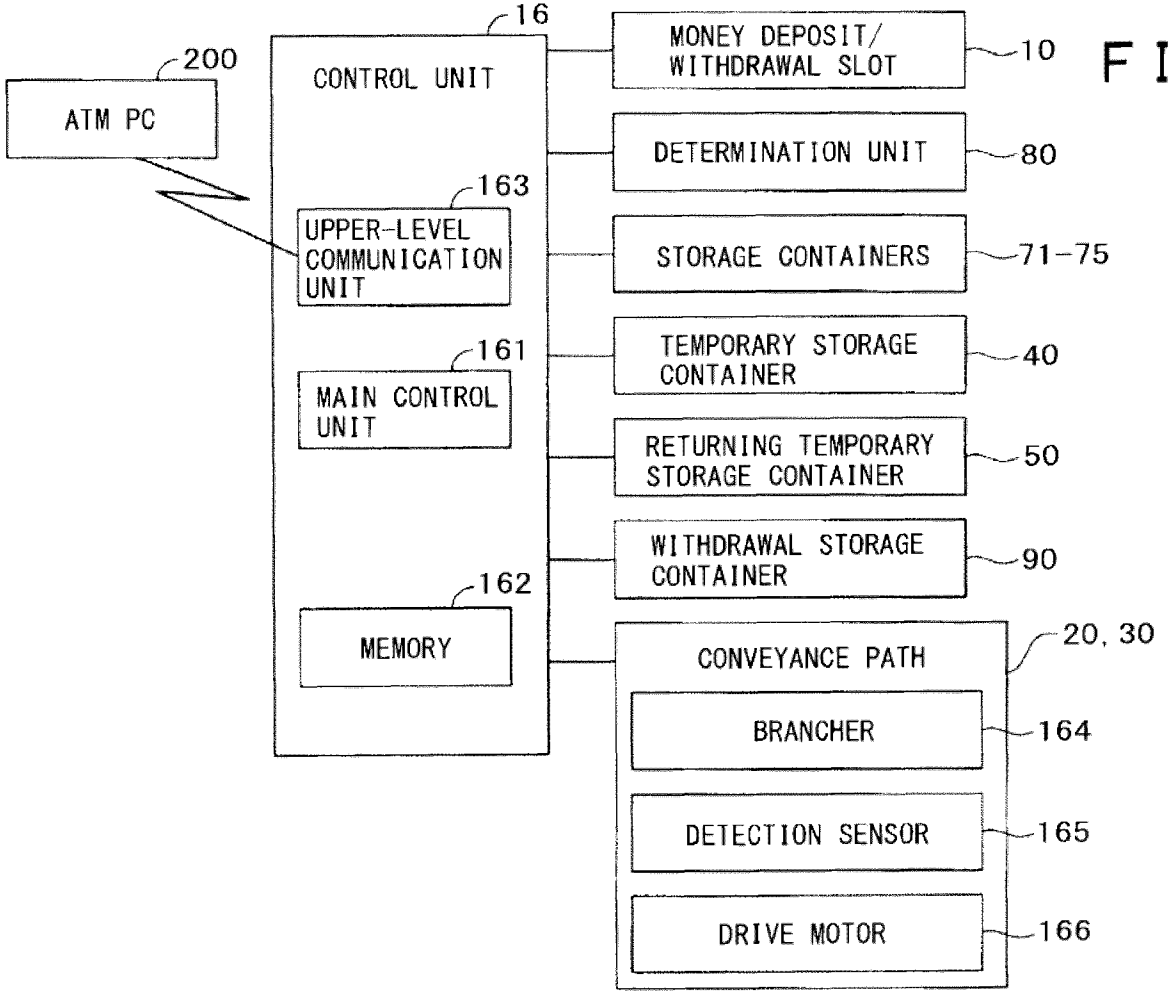
FIG. 4 is a control block diagram.

FIG. 4 illustrates a control block of the paper money handling apparatus 1.

The paper money handling apparatus 1 includes a control unit 16 which is not illustrated in FIG. 1. The control unit 16 includes a main control unit 161, a memory 162, and an upper-level communication unit 163. The main control unit 161 is used to control the above-described operation of the units illustrated in FIG. 1 or to acquire information (for example, the number of the stored paper money and the like) from sensors of the units by the use of the memory 162. The main control unit 161 communicates with an ATMPC 200 as an external apparatus via the upper-level communication unit 163.

The conveyance paths 20 and 30 include branchers G1 to 11, detection sensors 165, and drive motors 166 (the detailed description thereof will be made later). The conveyance path 30 will be generally referred to as conveyance paths 30*a* to 30*e*. The conveyance paths will be described in detail later.

The branchers G1 to 11 are used to select a branch path to which the paper money is conveyed from the branch point of the conveyance path. The branchers G1 to 11 are operated by electromagnetic solenoids or the like. The detection sensor 165 is used to output a detection signal involved with the passage of the paper money or the abnormal conveyance thereof. The drive motor 166 rotates to convey the paper money.

Figure 5:
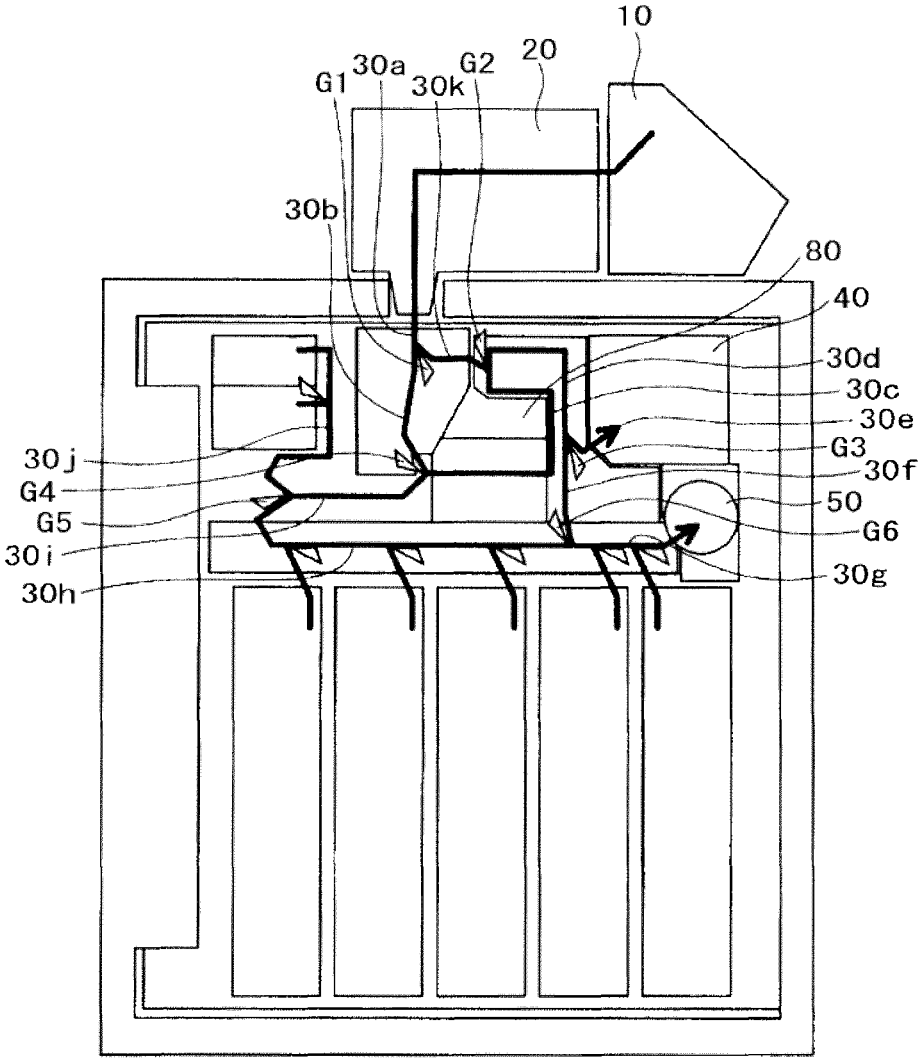
FIG. 5 is a diagram illustrating a deposit transaction process.

FIG. 5 is a diagram illustrating a deposit transaction process in the paper money handling apparatus 1 provided as the rear-face apparatus. Regarding this description, the same is also applied to the front-face apparatus and the wall-face apparatus. The deposit transaction includes a deposit counting process. In the deposit counting process for the paper money input to the pocket 10*a* of the money deposit/withdrawal slot 10, the authenticity and the kind of the paper money are determined and the number of the paper money is counted.

When the deposit transaction process starts, the control unit 16 continuously sends the paper money placed on the pocket 10*a* one by one to the conveyance path 30 through the conveyance path 20. Meanwhile, the control unit 16 connects the conveyance paths 30*a* and 30*b* to each other by the brancher G1 and connects the conveyance path 30*b* and the determination unit 80 to each other by the brancher G4 in order to convey the paper money to the conveyance path 30*b*. When the paper money reaches the determination unit 80, the determination unit 80 acquires the image of the paper money by a sensor mounted inside the determination unit 80. Based on the acquired image, the determination unit 80 determines the authenticity, the kind, and the loss state (the damage state) of the paper money.

When the paper money passes through the determination unit 80, the control unit 16 conveys the paper money by the conveyance path 30*c*. The determination of the determination unit 80 is completed during the conveyance. After the determination is completed, the control unit 16 switches the brancher G3 in response to the determination result. Specifically, whet the determination unit determines that the deposited paper money can be received, the control unit 16 connects the conveyance path 30*d* to the conveyance path 30*e* by the brancher G3. As a result, the paper money is stored in the temporary storage container 40. Meanwhile, when the determination unit determines that the deposited paper money cannot be received, the control unit 16 connects the conveyance path 30*d* to the conveyance path 30*f* by the brancher G3 and connects the conveyance path 30*f* to the conveyance path 30*g* by the brancher G6. As a result, the paper money is stored in the returning temporary storage container 50 through the conveyance path 30*g*.

When the paper money is stored in the returning temporary storage container 50, the control unit 16 sends all the paper money placed on the pocket 10*a* and conveys the paper money to the determination unit 80 by the use of the branchers G6, G5, and G4 and the conveyance paths 30*g*, 30*h*, and 30*i*. As a result, the determination of the determination unit 80 is performed again. As described above, the control unit 16 stores the paper money which is determined to be received by the re-determination inside the temporary storage container 40. Meanwhile, the control unit 16 returns the paper money which is determined not to be received to the money deposit/withdrawal slot 10 by the use of the branchers G2 and G1 and the conveyance paths 30*e*, 30*k*, and 30*a*. In this way, since the paper money which is determined once not to be received is read again, the possibility of returning the receivable paper money decreases.

When the control unit 16 treats ail the paper money input to the money deposit/withdrawal slot 10 in this way, the total sum of the paper money stored in the temporary storage container 40 is displayed on an indicator. When the user inputs information confirming that the displayed money is equal to the deposited money, the control unit 16 stores the paper money temporarily stored in the temporary storage container 40 into the storage containers 71 to 75 as will be described later (a deposit storage process).

Figure 6:
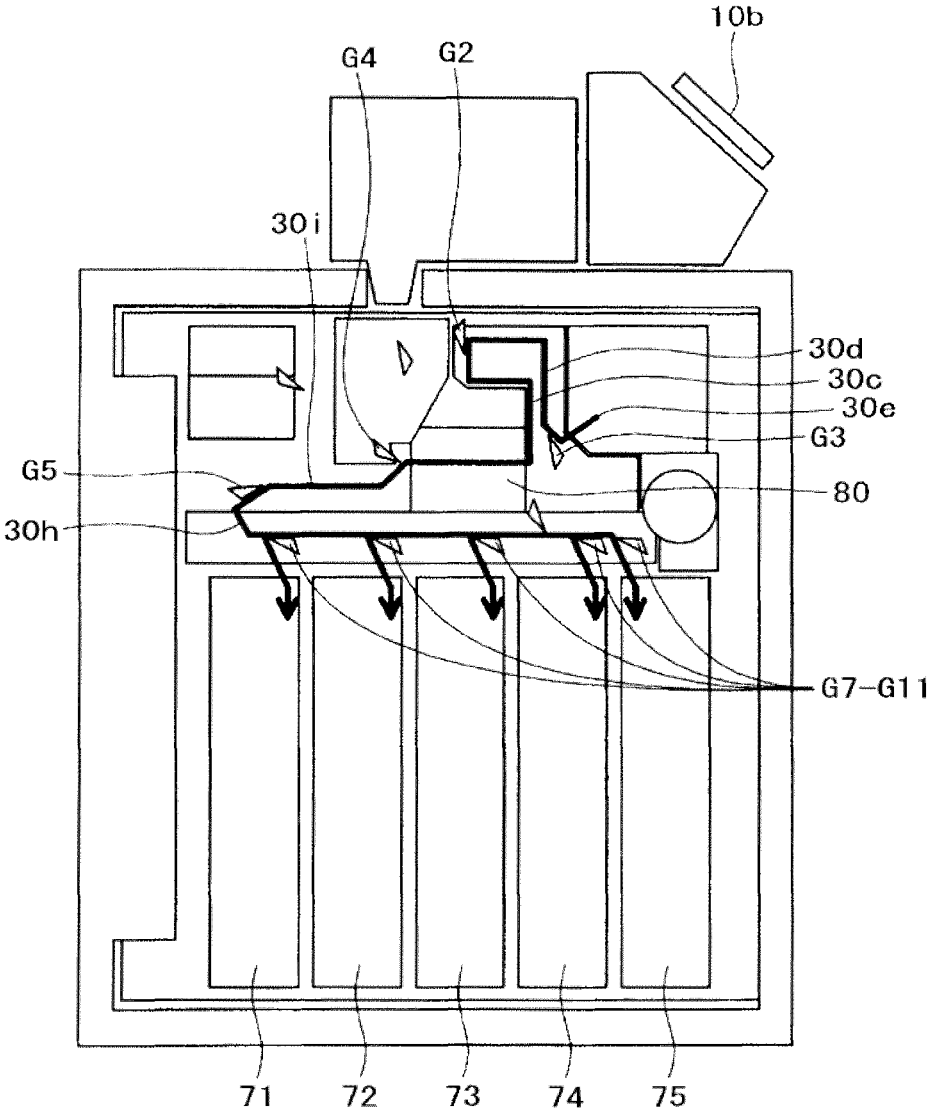
FIG. 6 is a diagram illustrating a deposit storage process.

FIG. 6 is a diagram illustrating a deposit storage process.

When the deposit storage process starts, the control unit 16 conveys the paper money to the lower part by the use of the branchers G3, G2, G4, and G5 and the conveyance paths 30*e*, 30*c*, 30*i*, and 30*h*. The control unit 10 selects any one of the storage containers 71 to 75 as a paper money storage target by the use of the branchers G7 to G11 in response to the kind of the paper money determined by the determination unit 80.

Figure 7:
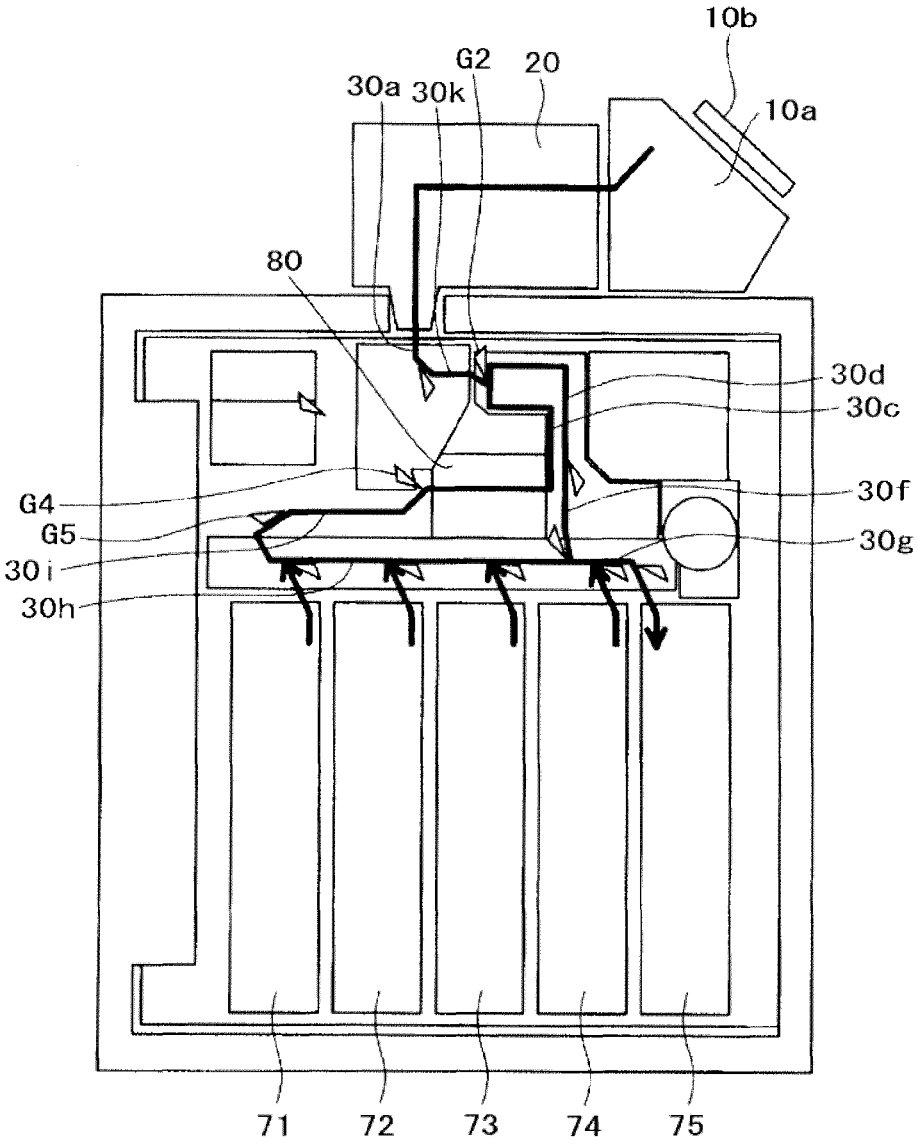
FIG. 7 is a diagram illustrating a withdrawal transaction process.

FIG. 7 is a diagram illustrating a withdrawal transaction process of the paper money handling apparatus 1.

When the withdrawal transaction process starts, the control unit 16 sends one by one the paper money stored in the storage containers 71 to 74 in accordance with the kind of the paper money. Subsequently, the control unit 16 conveys the sent paper money to the determination unit 80 by the use of the conveyance paths 30*h* and 30*i*. The determination unit 80 determines whether the conveyed paper money can be withdrawn. When the determination unit determines that the conveyed paper money can be withdrawn, the control unit 16 connects the conveyance path 30*c* and the conveyance path 30*k* to each other by the use of the brancher G2. Subsequently, the control unit 16 conveys the paper money to the pocket 10*a* by the use of the conveyance path 30*a* and the conveyance path 20.

Meanwhile, when the determination unit determines that the conveyed paper money cannot be withdrawn, the control unit 16 connects the conveyance path 30*c* and the conveyance path 30*d* to each other by the use of the brancher G2. Subsequently, the control unit 16 stores the paper money in the storage container 75 by the use of the conveyance paths 30*f* and 30*g*. The determination of the paper money and the switching of the brancher G2 based on the determination result during the withdrawal are completed before the paper money reaches the brancher G2.

After all the paper money to be withdrawn is conveyed to the pocket 10*a*, the control unit 16 opens the shutter 10*b*. When the user takes the paper money away from the pocket 10*a*, the control unit 16 ends the withdrawal transaction process by closing the shutter 10*b*.

Figure 8:
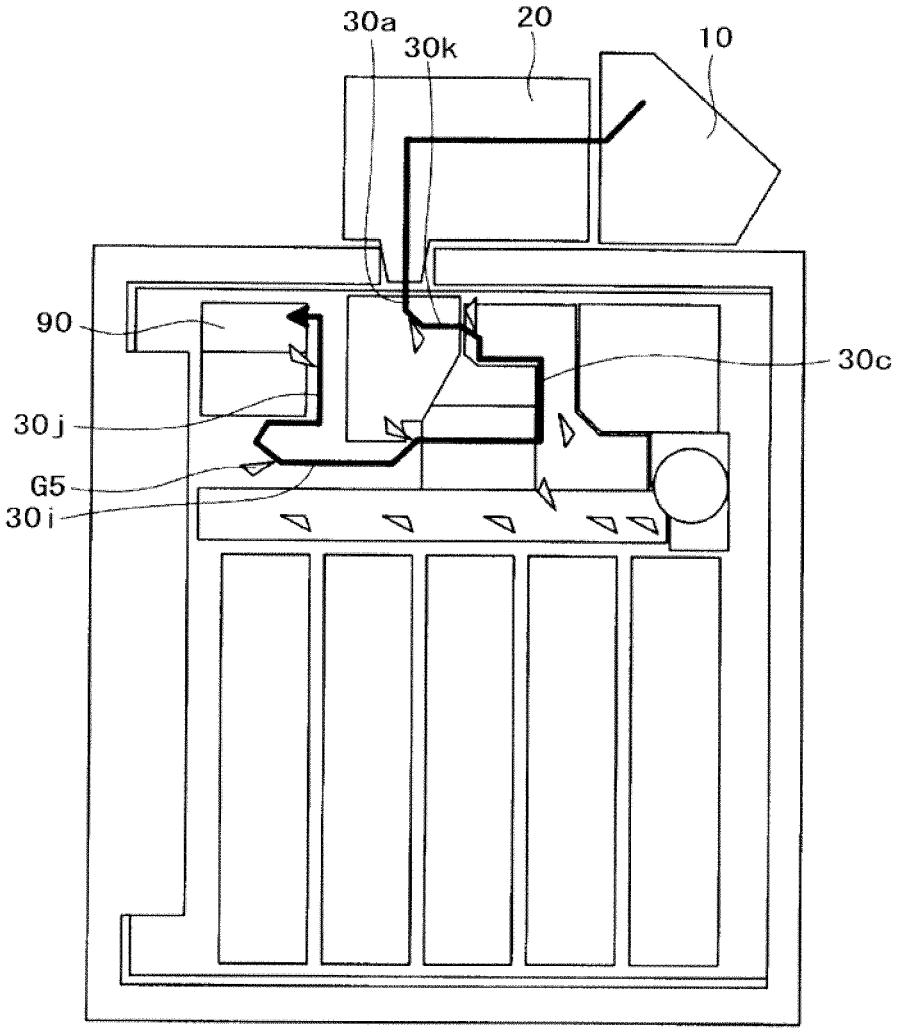
FIG. 8 is a diagram illustrating a process of collecting forgotten paper money.

FIG. 8 is a diagram illustrating a process of collecting the forgotten paper money.

The collection process is a process of collecting the paper money into the withdrawal storage container 90 (or the storage container 74 or the storage container 75) when the user forgets to extract the paper money placed on the pocket 10*a* for the withdrawal transaction process.

When the paper money is left on the pocket 10*a* for a predetermined time, the control unit 16 sends the paper money one by one from the pocket 10*a* to the conveyance path 20. Subsequently, the paper money is stored in the withdrawal storage container 90 by the use of the conveyance paths 30*a*, 30*k*, 30*c*, 30*i*, and 30*j*, and the collection process ends.

Figure 9:
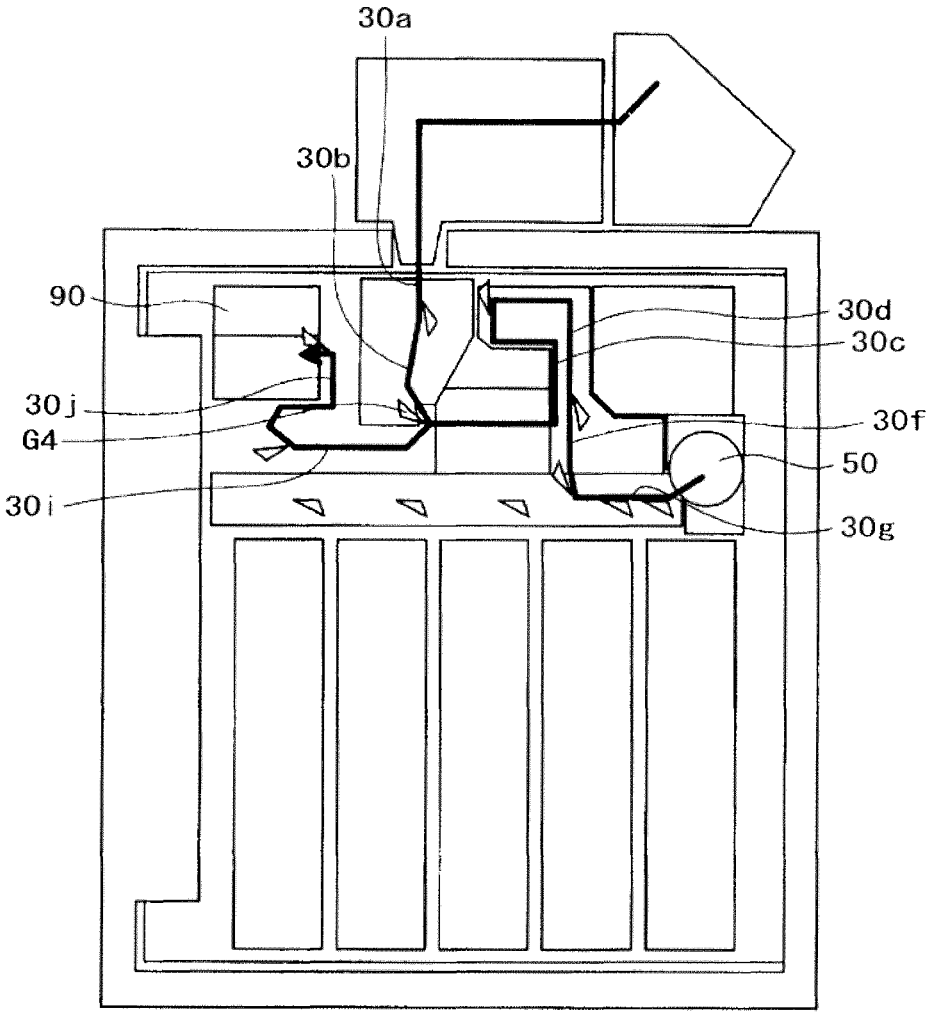
FIG. 9 is a diagram illustrating a process performed when counterfeit paper money is detected.

FIG. 9 illustrates an example of an operation performed when the counterfeit paper money is detected by the determination unit 80 during the deposit counting process. This operation is performed in order to store the counterfeit paper money found during the deposit transaction process into a space different from the other paper money.

When the determination unit 80 detects the counterfeit paper money in the deposit transaction process, the control unit 16 temporarily stores the paper money into the returning temporary storage container 50 separately from the paper money to be returned due to the other reasons. In order to distinguish the paper money from the others, a certain operation is performed by a reel, a tape, a wheel, and a roller provided in the returning temporary storage container 50. With such a configuration, the control unit 16 conveys the paper money one by one to the returning temporary storage container 50 and memorizes the counterfeit paper money as the location order in the memory 162.

When the determination unit 80 determines each of all the paper money placed on the pocket 10*a*, the control unit 16 sends the paper money one by one from the returning temporary storage container 50. When the paper money which is determined as the counterfeit paper money is sent, the control unit 16 conveys the paper money to the determination unit 80 by the use of the conveyance paths 30*g*, 30*f*, 30*d*, and 30*c*. The control unit 16 conveys the paper money which is determined as the normal paper money by the determination unit 80 to the pocket 10*a* by the use of the conveyance paths 30*b* and 30*a*. Then, the control unit 16 conveys the paper money which is determined as the counterfeit paper money to the withdrawal storage container 90 by the use of the conveyance paths 30*i* and 30*j* and the brancher G4.

According to the first embodiment, since the money deposit/withdrawal slot 10 is provided outside the safe A, the operability of the money deposit/withdrawal slot 10 is not degraded even when the wall of the safe A is thickened. Further, according to the first embodiment, it is possible to temporarily store the abnormal (damaged) paper money and to return the paper money. Furthermore, according to the first embodiment, the normal paper money which is determined by the second determination can be received in a normal routine. Moreover, according to the first embodiment, it is possible to store the counterfeit paper money in the withdrawal storage container separately from the normal paper money. Finally, according to the first embodiment, since the withdrawal storage container is disposed in the vicinity of the door B, the paper money inside the withdrawal storage container 90 can be easily collected.

Second Embodiment

In a second embodiment, the non-withdrawable paper money and the non-depositable paper money are separately stored.

Figure 10:
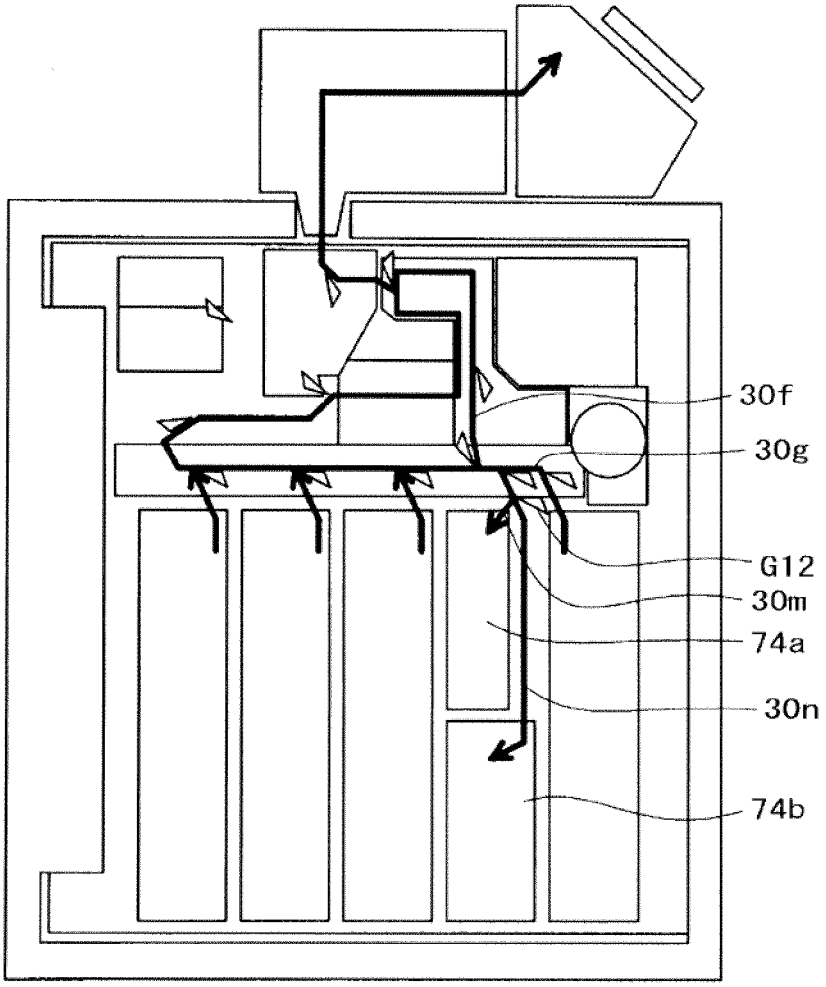
FIG. 10 is a diagram illustrating a process of separately storing non-withdrawable paper money and non-depositable paper money (a second embodiment).

FIG. 10 is a diagram illustrating a storage configuration.

As illustrated in FIG. 10, the storage container 74 is divided into a storage area 74*a* and a storage area 74*b*. The storage area 74*a* occupies the upper part of the storage container 74, and the storage area 74*b* occupies the lower part of the storage container 74.

The control unit 16 stores the paper money which is determined not to be withdrawn in the withdrawing transaction process by she determination unit 80 is stored in the storage area 74*a* by the use of the conveyance paths 30*f*, 30*g*, and 30*m*. The control unit 16 stores the paper money which is determined not to be deposited in the deposit transaction process in the storage area 74*b* by the use of the conveyance paths 30*f*, 30*g*, and 30*n*. This positional relation may be set reversely. The two stages of storage areas may be provided at the position of the storage container 75.

Third Embodiment

In a third embodiment, the non-withdrawable paper money is stored in the withdrawal storage container 90.

Figure 11:
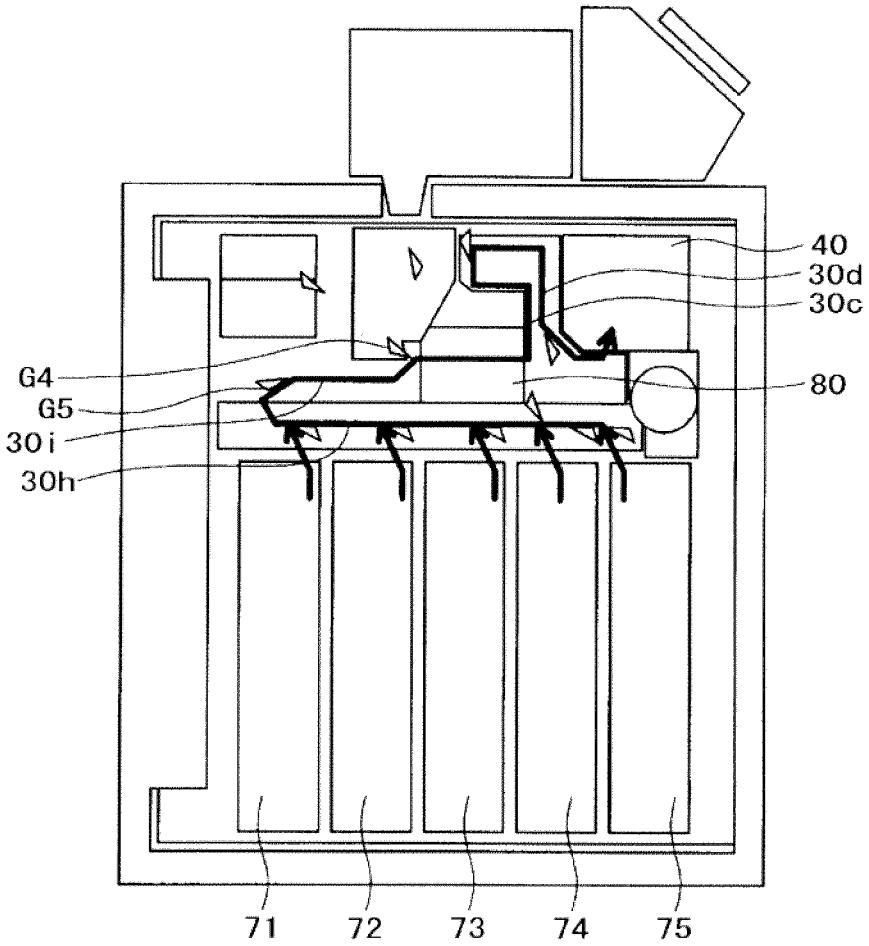
FIG. 11 is a diagram illustrating a process of storing non-withdrawable paper money into a withdrawal storage container (a third embodiment).
Figure 12:
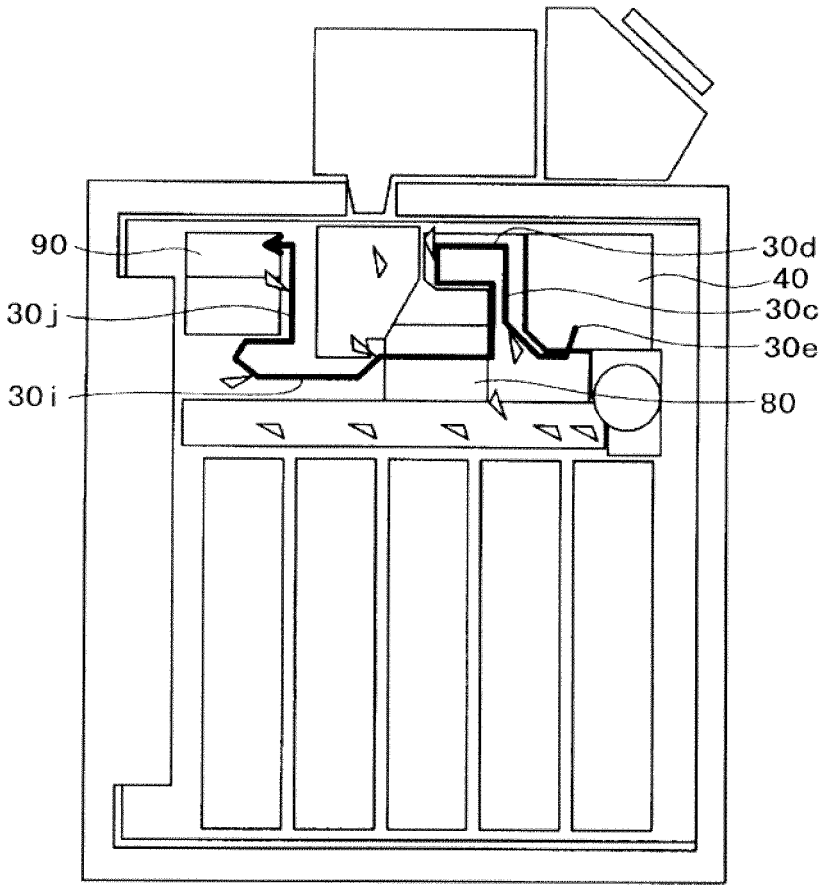
FIG. 12 is a diagram illustrating a process of storing non-withdrawable paper money into a withdrawal storage container (the third embodiment).

FIGS. 11 and 12 are diagrams illustrating a process of storing the non-withdrawable paper money in the withdrawal storage container 90.

The control unit 16 stores the paper money which is determined not to be withdrawn by the determination unit 80 in the temporary storage container 40. The control unit 16 withdraws the paper money for the traction to the money deposit/withdrawal slot 10 and stores the non-withdrawable paper money stored in the temporary storage container 40 into the withdrawal storage container 90 by the conveyance paths 30*e*, 30*c*, 30*d*, 30*i*, and 30*j* as illustrated in FIG. 12.

Fourth Embodiment

In a fourth embodiment, the non-withdrawable paper money is temporarily stored in the returning temporary storage container 50 and is stored in the withdrawal storage container 90.

Figure 13:
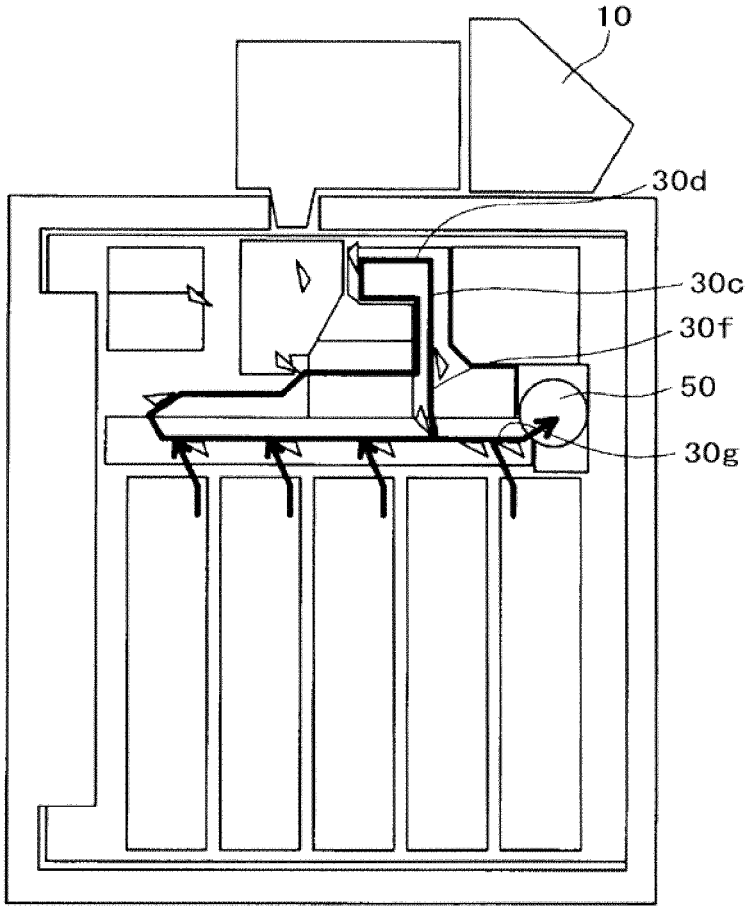
FIG. 13 is a diagram illustrating a process of storing non-withdrawable paper money into a returning temporary storage container (a fourth embodiment).
Figure 14:
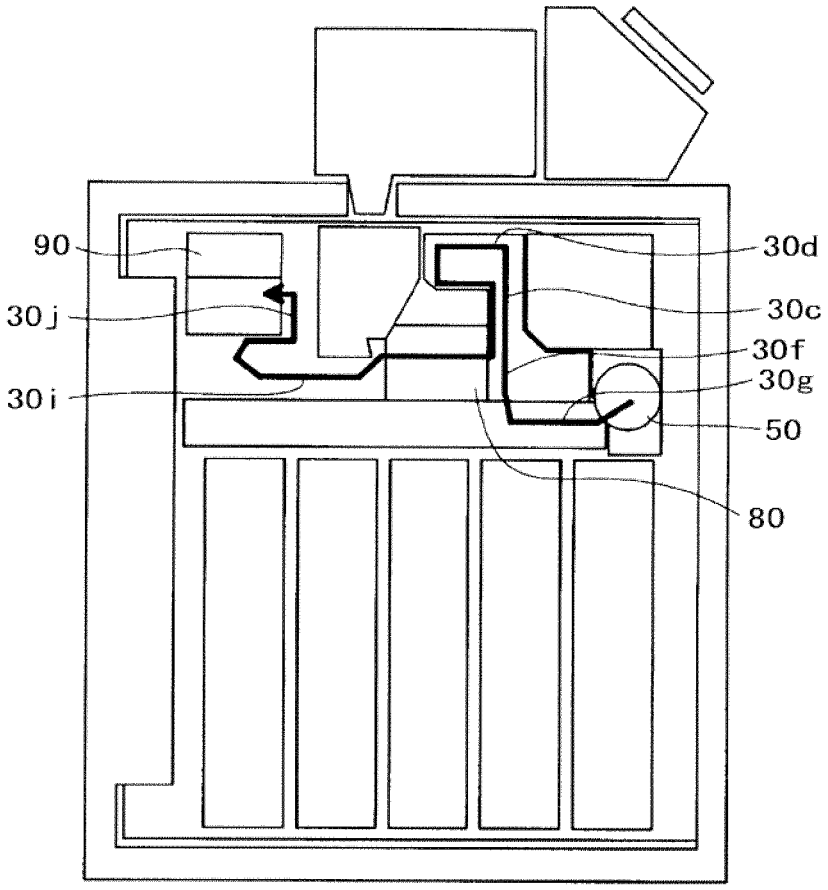
FIG. 14 is a diagram illustrating a process of storing non-withdrawable paper money into a returning temporary storage container (the fourth embodiment).

FIGS. 13 and 14 are diagrams illustrating a process of temporarily storing in the returning temporary storage container 50 and storing the non-withdrawable paper money in the withdrawal storage container 90.

The control unit 15 stores the paper money which is determined not to be withdrawn by the determination unit 80 into the returning temporary storage container 50 by the use of the conveyance paths 30*d*, 30*f*, and 30*g* as illustrated in FIG. 13. The control unit 16 withdraws the paper money to be withdrawn to the money deposit/withdrawal slot 10 and stores the paper money stored in the returning temporary storage container 50 into the withdrawal storage container 90 by the use of the conveyance paths 30*g*, 30*f*, 30*c*, 30*d*, 30*i*, and 30*j* as illustrated in FIG. 14.

Fifth Embodiment

In a fifth embodiment, the forgotten paper money is stored in any one of the storage container 74 and the storage container 75.

Figure 15:
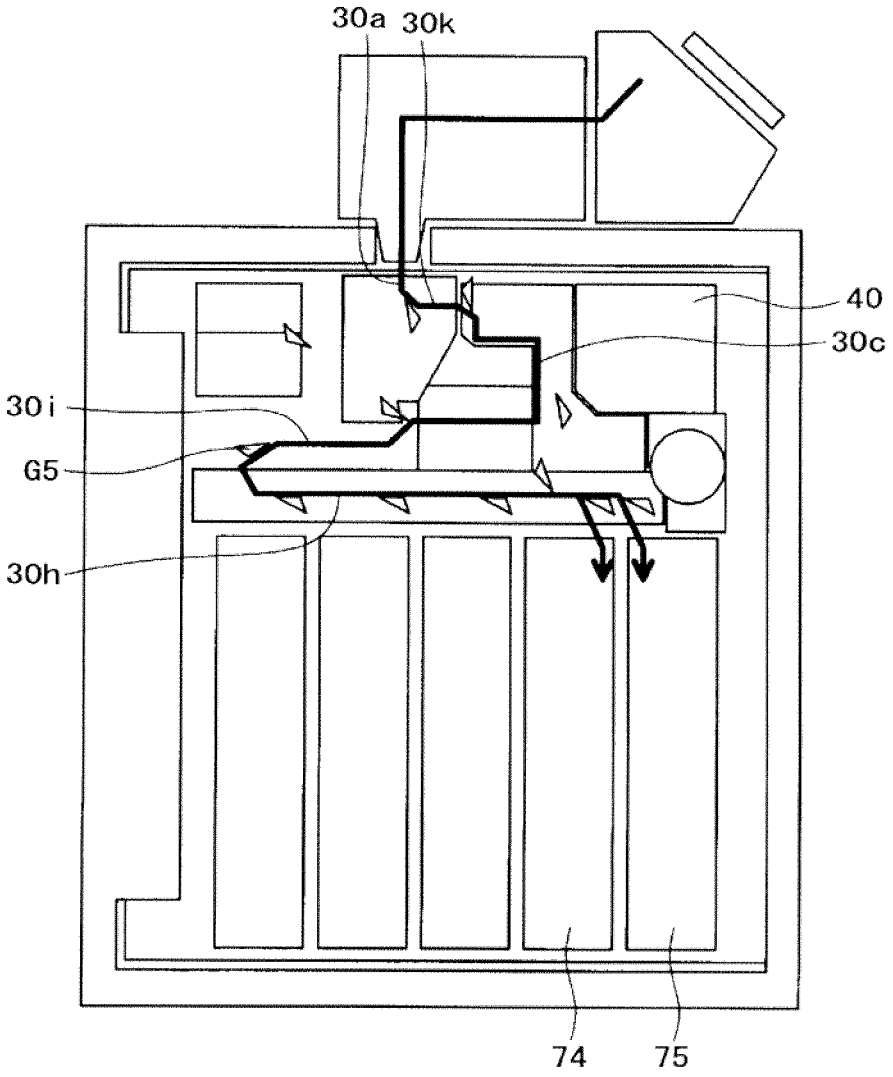
FIG. 15 is a diagram illustrating a process of storing forgotten paper money into a storage container (a fifth embodiment).

FIG. 15 illustrates a process of storing the forgotten paper money into the storage container 74 or the storage container 75.

When the paper money is left in the pocket 10*a* for a predetermined time, the control unit 16 sends the paper money one by one from the pocket 10*a* to the conveyance path 20. Subsequently, the paper money is stored in the storage container 74 or the storage container 75 by the use of the conveyance paths 30*a*, 30*k*, 30*c*, 30*i*, and 30*h*, and the collection process ends.

Sixth Embodiment

In a sixth embodiment, a conveyance path different from the fifth embodiment is employed when the forgotten paper money is stored in any one of the storage container 74 and the storage container 75.

Figure 16:
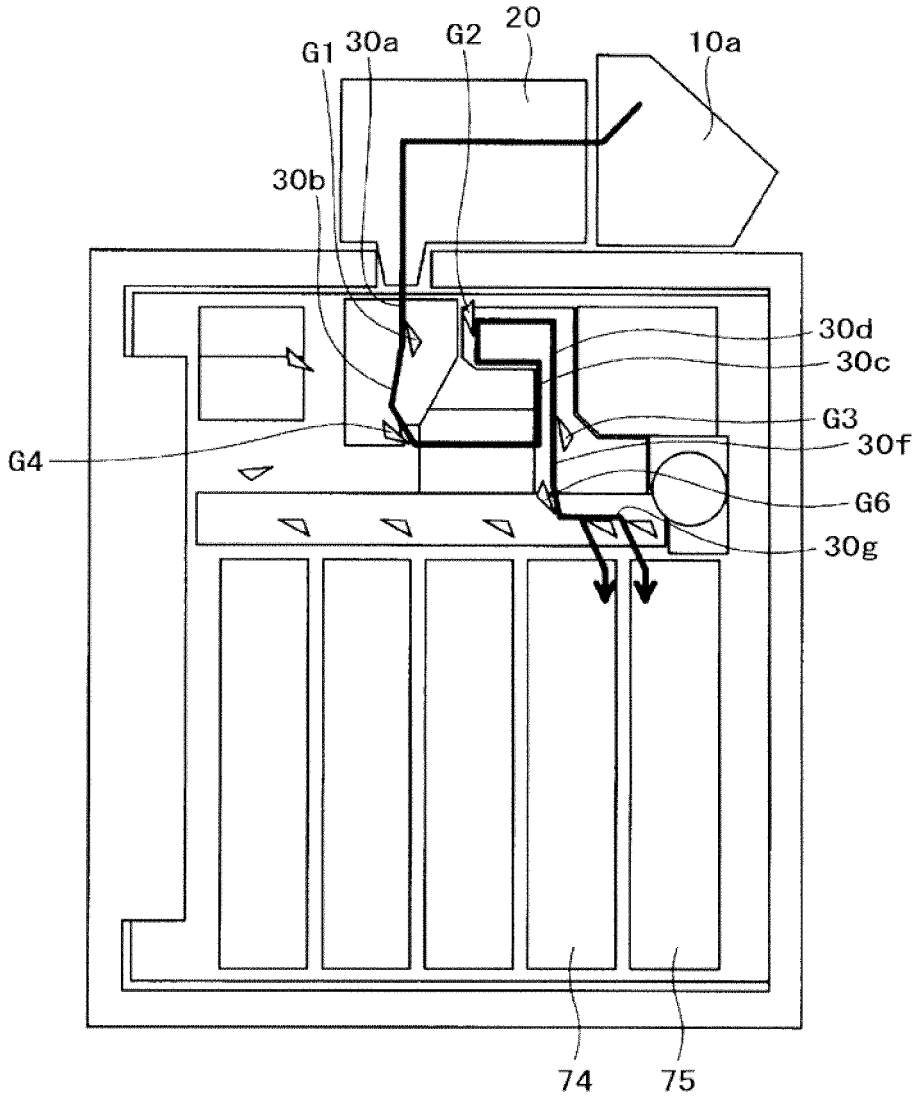
FIG. 16 is a diagram illustrating a process of storing forgotten paper money into a storage container (a sixth embodiment).

FIG. 16 illustrates a process of storing the forgotten paper money into the storage container 74 or the storage container 75.

The control unit 16 stores the paper money sent to the conveyance path 20 into the storage container 74 or the storage container 75 by the use of the conveyance paths 30*a*, 30*b*, 30*c*, 30*d*, and 30*f*.

Seventh Embodiment

In a seventh embodiment, the paper money is directly stored in the storage containers 71 to 75 from the money deposit/withdrawal slot 10 without being stored in the temporary storage container 40. This method has an advantage that the process can be performed fast.

Figure 17:
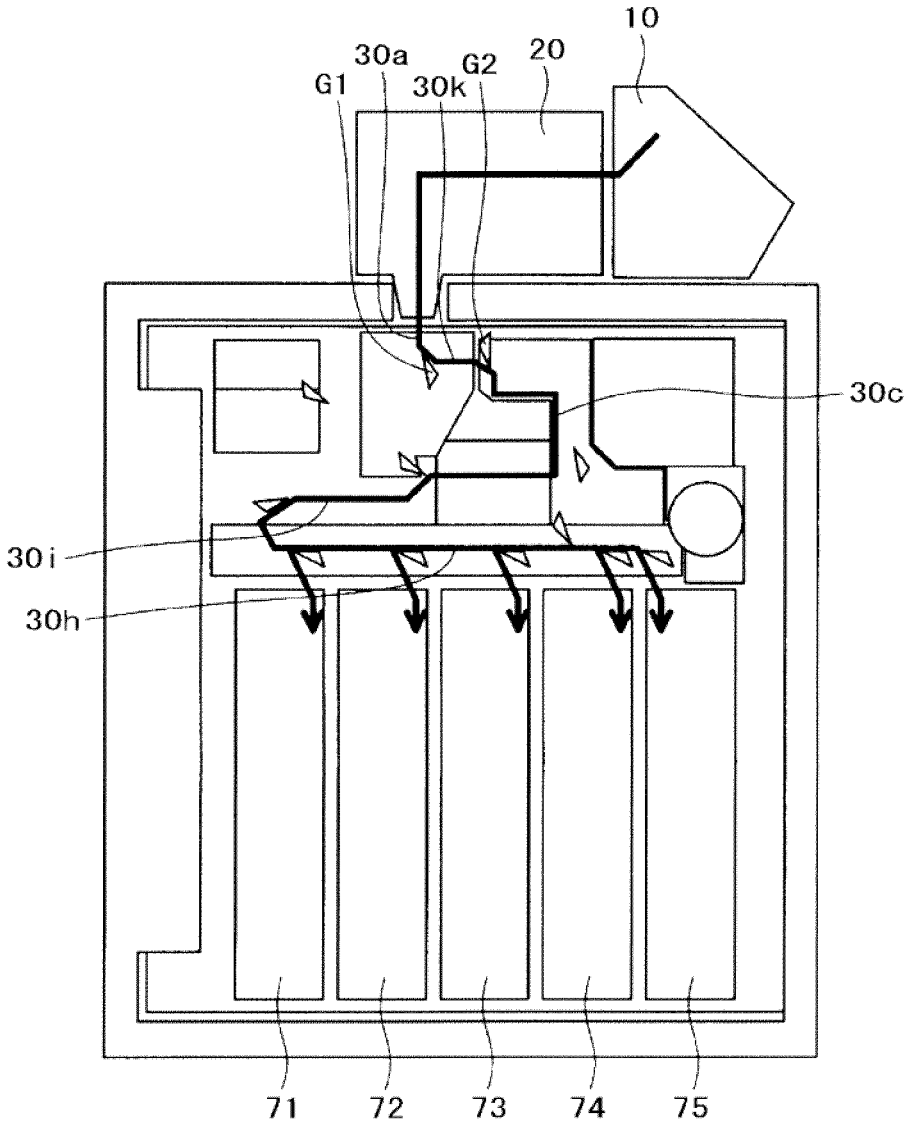
FIG. 17 is a diagram illustrating a process of directly storing paper money into a storage container (a seventh embodiment).

FIG. 17 is a diagram illustrating a deposit operation of the seventh embodiment.

The control unit 16 carries the paper money into the determination unit 80 from the rear side by the use of the conveyance paths 20, 30*a*, and 30*c* and the branchers G1 and G2. The control unit 16 conveys the paper money discharged from the front side of the determination unit 80 to the lower part by the use of the conveyance paths 30*i* and 30*h*. The control unit 16 stores the paper money into any one of the storage containers 71 to 75 in response to the kind of the paper money determined by the determination unit 80.

Eighth Embodiment

In an eighth embodiment, the counterfeit paper money found during the deposit transaction process is temporarily stored in the temporary storage container 40 along with the normal paper money and the normal paper money and the counterfeit paper money are sorted during a storage operation.

Figure 18:
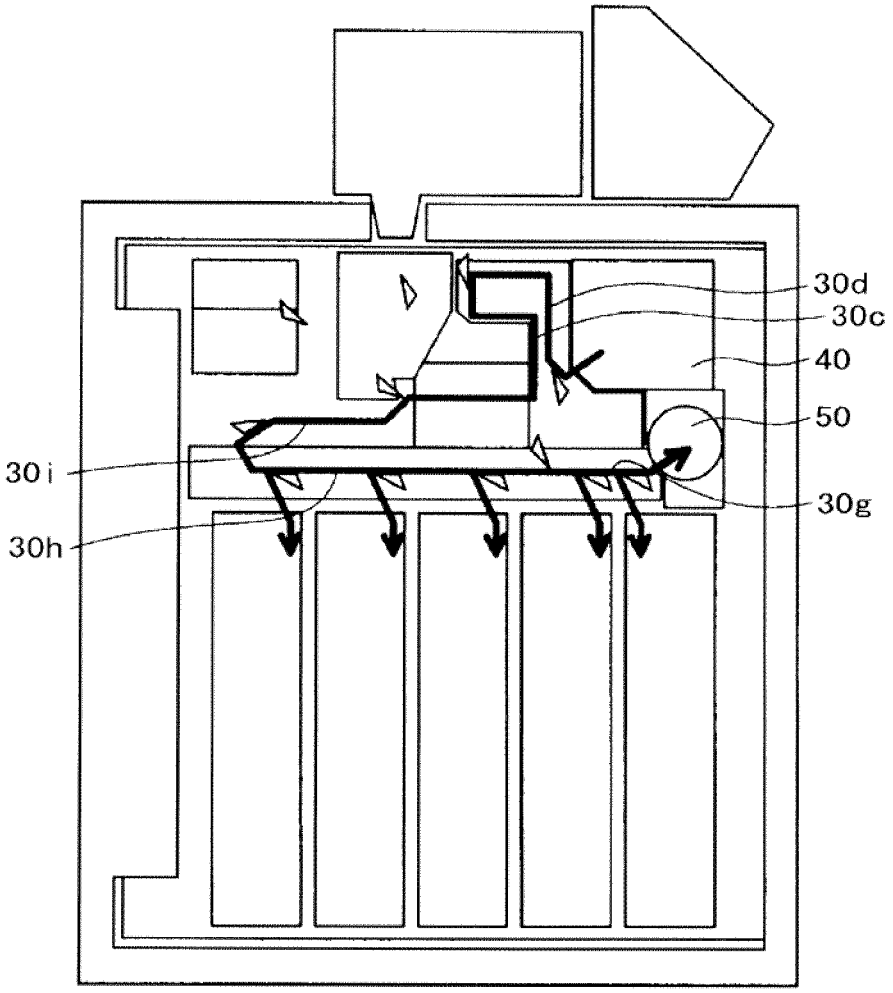
FIG. 18 is a diagram illustrating a process of storing counterfeit paper money into a temporary storage container and sorting the counterfeit paper money separately from normal paper money during a storage operation (an eighth embodiment).
Figure 19:
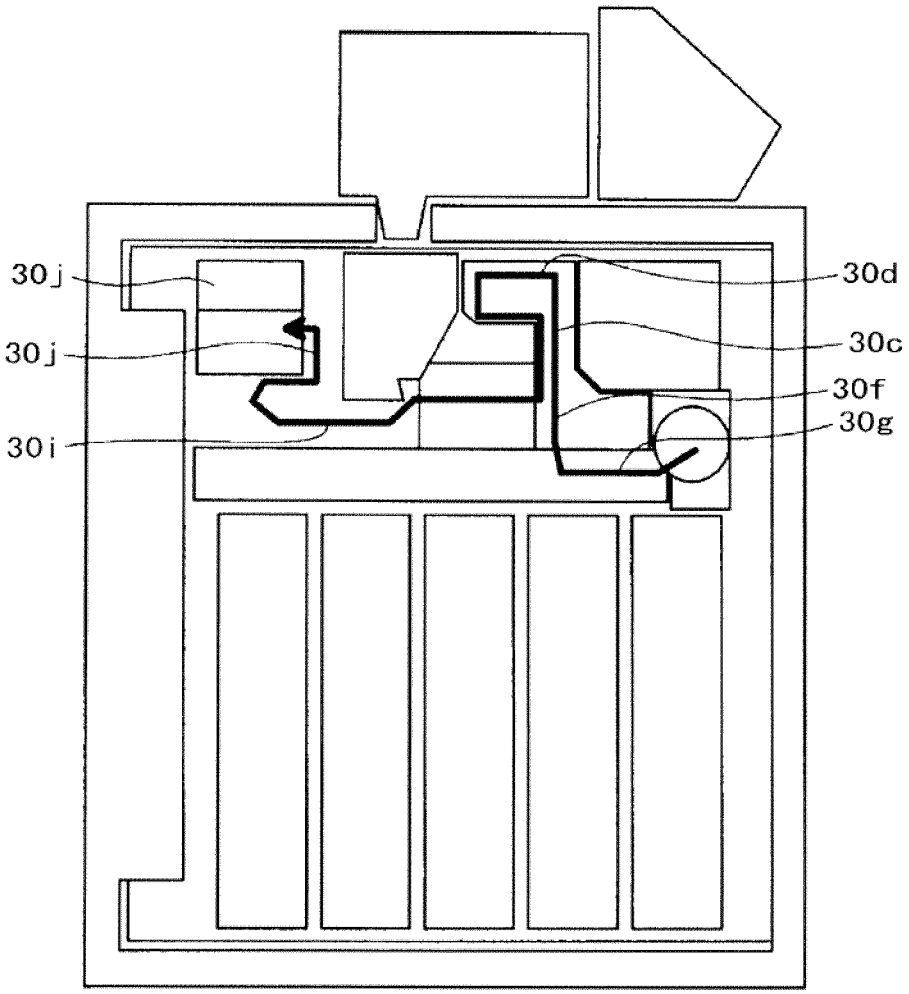
FIG. 19 is a diagram illustrating a process of storing counterfeit paper money into a temporary storage container and sorting the counterfeit paper money separately from normal paper money during a storage operation (the eighth embodiment).

FIGS. 18 and 19 are diagrams illustrating a sorting operation.

The control unit 16 carries the paper money stored in the temporary storage container 40 into the determination unit 80 by the use of the conveyance paths 30*e*, 30*d*, and 30*c*. The control unit 16 stores the paper money which is determined to be normal by the determination unit 80 into the storage containers 71 to 75 by the use of the conveyance paths 30*i* and 30*h*. The control unit 16 temporarily stores the paper money determined as the counterfeit paper money into the returning temporary storage container 50 by the use of the conveyance path 30*g* as illustrated in FIG. 18. After all the normal paper money is stored in the storage containers 71 to 75, the control unit 16 stores the counterfeit paper money temporarily stored in the returning temporary storage container 50 into the withdrawal storage container 90 by the use of the conveyance paths 30*g*, 30*f*, 30*d*, 30*c*, and 30*i* as illustrated in FIG. 19.

Furthermore, the invention is not limited to the above-described embodiments, and includes various modified examples. For example, the above-described embodiments are just used to help the comprehension of the invention, and the invention does not need to essentially have all those configurations. Further, a part of a configuration of a certain embodiment can be replaced by the configuration of the other embodiments. Furthermore, a part of a configuration of a certain embodiment can be added, omitted, or substituted.

Further, a part or the entirety of the configuration, the function, the process unit, and the process mechanism may be realized by, for example, hardware obtained by the design of a storage circuit. Further, the configuration and the function may be realized by software of analyzing and executing a program for realizing a function of each processor. Information on a program, a table, and a file for realizing each function can be stored in a recording device such as a memory, a hard disk, and a solid state drive (SSD) or a recording medium such as an IC card, an SD card, and a DVD (trademark).

Further, a control line or an information line necessary for the description is illustrated in the drawings, and hence all control lines or information lines in the apparatus are not illustrated in the drawings. In fact, most of the configurations are connected to one another.

REFERENCE SIGNS LIST

1 Paper money handling apparatus
10 Money deposit/withdrawal slot
10*a* Pocket
10*b* Shutter
16 Control unit
20 Conveyance path
30*a* to 30*n* Conveyance path
40 Temporary storage container
50 Returning temporary storage container
71 to 75 Storage container
74*a* and 74*b* Storage area
80 Determination unit
90 Withdrawal storage container
161 Main control unit
162 Memory
163 Upper-level communication unit
165 Detection sensor
166 Drive motor
200 ATMPC
A Safe
B Poor
G1 to G11 Brancher

The invention claimed is:

1. A paper money handling apparatus comprising:
a repository which is provided inside a safe to store paper money therein;
a temporary storage container which is provided inside the safe to temporarily store deposited paper money therein during a transaction until the transaction of the paper money deposited by a user is admitted;
a money deposit/withdrawal slot which is provided outside the safe and is provided with a pocket inclined with respect to a horizontal plane so that the user extracts paper money placed thereon; and
a conveyance unit which penetrates a top surface of the safe to convey paper money among the repository, the temporary storage container, and the money deposit/withdrawal slot.

2. The paper money handling apparatus according to claim 1, further comprising:
a determination unit which determines whether paper money is normal; and
a second temporary storage container which temporarily stores paper money determined not to be normal by the determination unit.

3. The paper money handling apparatus according to claim 2,
wherein the determination unit determines again the paper money determined not to be normal and returns the paper money determined not to be normal again.

4. The paper money handling apparatus according to claim 1, further comprising:
a withdrawal storage container which stores counterfeit paper money.

5. The paper money handling apparatus according to claim 4,
wherein the withdrawal storage container is disposed inside the safe so as to be located near a door of the safe in relation to the center of the safe.

6. The paper money handling apparatus according to claim 1,
wherein the money deposit/withdrawal slot is able to change the arrangement thereof inside the upper part of the safe.

7. The paper money handling apparatus according to claim 1,
wherein responsive to a confirmation that a total sum of the deposited paper money stored in the temporary storage container is correct, the deposited paper money temporarily stored in the temporary storage is stored into the repository.

8. The paper money handling apparatus according to claim 1,
wherein a total sum of the deposited paper money stored in the temporary storage container is displayed on an indicator; and
wherein responsive to a confirmation that the displayed total sum of the deposited paper money stored in the temporary storage container is equal to an amount of the deposited paper money by the user, the deposited paper money temporarily stored in the temporary storage is stored into the repository.

* * * * *